US005607070A

United States Patent [19]

Hellyer

[11] Patent Number: 5,607,070

[45] Date of Patent: Mar. 4, 1997

[54] MODULAR DISPLAY FIXTURE SYSTEM

[75] Inventor: Daniel P. Hellyer, Lawrence, Kans.

[73] Assignee: E & E Specialties, Inc., Lawrence, Kans.

[21] Appl. No.: 262,537

[22] Filed: Jun. 20, 1994

[51] Int. Cl.[6] ..... A47B 43/00

[52] U.S. Cl. ..... 211/189; 211/193; 211/187

[58] Field of Search ..... 211/189, 193, 211/187, 94, 87; 52/239, 36.5, 36.6, 764, 762; 5/299

[56] References Cited

U.S. PATENT DOCUMENTS

| | | | |
|---|---|---|---|
| 954,563 | 6/1909 | Duke | 5/299 |
| 3,217,894 | 11/1965 | Shewell | 211/187 |
| 3,473,671 | 5/1967 | Gangitano | 211/87 |
| 3,601,256 | 8/1971 | Bowers, Jr. | 211/187 |
| 3,856,320 | 12/1974 | Blanchard | 211/187 |
| 4,588,096 | 5/1986 | Story et al. | 211/189 |
| 4,616,756 | 10/1986 | Holtz | 211/189 |
| 4,878,583 | 11/1989 | Paquette et al. | 211/94 |
| 5,142,832 | 9/1992 | Branham, Sr. et al. | 211/87 |
| 5,255,803 | 10/1993 | Pavone et al. | 211/189 |

FOREIGN PATENT DOCUMENTS

| | | | |
|---|---|---|---|
| 985991 | 2/1949 | France | 5/299 |
| 2296389 | 7/1976 | France | 211/193 |

*Primary Examiner*—Leslie A. Braun
*Assistant Examiner*—Willie Berry, Jr.
*Attorney, Agent, or Firm*—Hovey, Williams, Timmons & Collins

[57] ABSTRACT

A modular display fixture which is strong and portable, yet easy to assemble and disassemble without the use of tools. A novel securement tab for securely connecting a plurality of display fixtures together to form a multi-fixture display system is also provided. The display fixture includes a support frame including a pair of parallel, spaced-apart support posts connected by a cross member, and a planar display panel removably mounted between the spaced-apart support posts. The support frame and the removable panel include novel connecting structure which allow the display fixture to be assembled and disassembled without the use of tools.

6 Claims, 6 Drawing Sheets

MODULAR DISPLAY FIXTURE SYSTEM

BACKGROUND OF THE INVENTION

1. Field of the Invention

The present invention is related to display fixtures for displaying goods. More particularly, the invention is related to a modular display fixture which is strong and portable, yet easy to assemble and disassemble. The preferred invention is also related to a novel securement tab which securely connects a plurality of display fixtures together to form a multi-fixture display system.

2. Description of the Prior Art

Goods sold in retail and wholesale stores are commonly displayed on racks or shelves to increase their visibility to consumers. It is advantageous to reposition these racks and shelves periodically to adjust to changing store conditions and customer needs. However, most display systems on the market today are large and cumbersome and thus cannot be repositioned easily. Moreover, many of these display systems are either permanently assembled or require assembly using nuts, bolts, screws, etc. The need for tools greatly increases assembly time and defeats portability.

Portable display racks are known in the art; however, many of these portable display racks are also fastened together using nuts, bolts, screws, etc, thus defeating the portability function. Another drawback of currently available portable display racks is that they cannot be quickly and easily connected to other display racks to create a custom-sized display system.

SUMMARY OF THE INVENTION

The present invention overcomes the problems outlined above and provides a display fixture which is not only strong and portable, but also easy to assemble, disassemble and fasten to other display fixtures. The preferred display fixture broadly includes a support frame including a pair of parallel, spaced-apart support posts connected by a cross member, and a planar display panel removably mounted between the spaced-apart support posts. The support frame and the removable panel include novel connecting means which allow the display fixture to be assembled and disassembled without the use of tools.

The preferred display fixture also includes an extension assembly for increasing the height of the display fixture. The extension assembly includes a pair of tubular extension posts and novel connection means adapted for connecting the extension posts with the support frame support posts. The invention also includes novel securement tabs for securing adjacent display fixtures to one another to create a custom-sized display system which is easy to assemble and disassemble.

The preferred invention provides many advantages. For example, the display fixture's modular design and novel connection means provides a display which is strong and portable, yet easy to assemble and disassemble. Moreover, the preferred connection means allows the display fixture to be assembled and disassembled quickly without tools. Additionally, the securement tabs allow multiple display fixtures to be connected together to create a larger, custom-sized display system which can display nearly any quantity of goods.

DETAILED DESCRIPTION OF THE PREFERRED EMBODIMENTS

Figure 1:
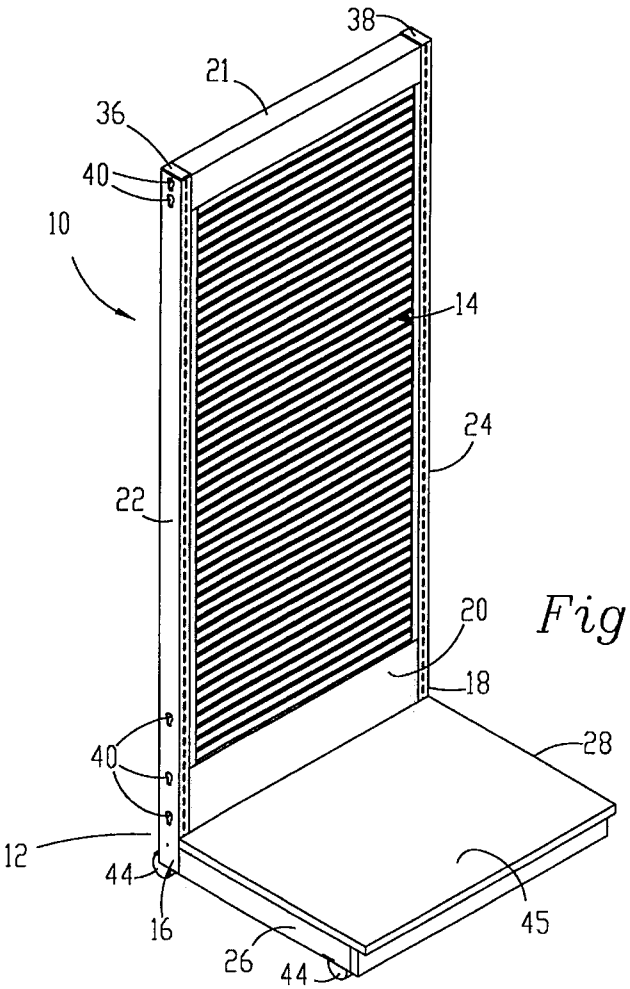
FIG. 1 is a perspective view of an assembled display fixture in accordance with the preferred embodiment of the invention.
Figure 2:
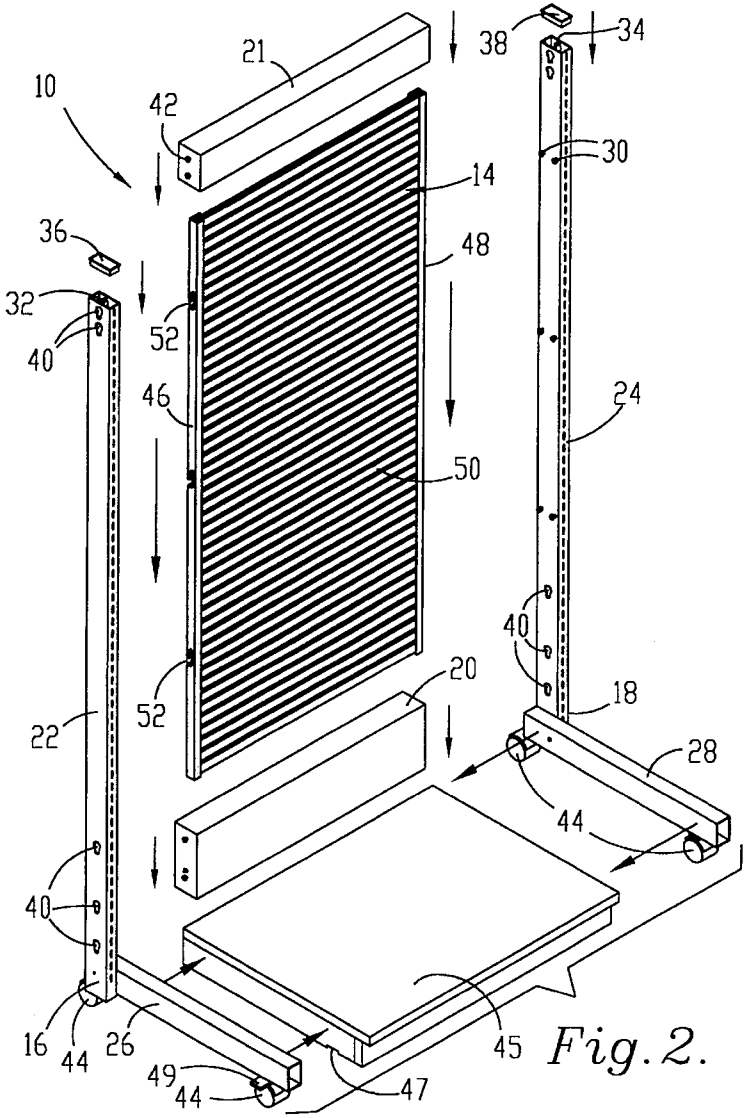
FIG. 2 is an exploded isometric view of the display fixture.

Turning now to the drawings, and particularly FIGS. 1 and 2, a display fixture 10 is illustrated. The preferred display fixture 10 broadly includes a support frame 12 and display panel 14.

In more detail, support frame 12 includes a pair of spaced-apart tubular support posts 16 and 18, and connecting cross members 20 and 21. Support posts 16 and 18 form the left and right side outer margins of display fixture 10, respectively and are substantially identical. Support posts 16 and 18 are generally L-shaped in overall configuration and include vertically extending upright members 22 and 24 and horizontally extending lower members 26 and 28 respectively.

As illustrated in FIG. 2, upright members 22 and 24 are each preferably of hollow tubular construction and present rectangular-shaped openings respectively 32 and 34 at their upper ends. Openings 32 and 34 may be closed by caps 36 and 38 or may receive an extension assembly as described in detail below. A plurality of connection pins 30 extend inwardly from the interior surface of each of the upright members 22 and 24. As described in detail below, connection pins 30 secure display panel 14 to support frame 12. Upright members 22 and 24 also include structure defining a plurality of key hole-shaped slots 40 adapted for securing cross members 20 and 21 and for receiving a securement tab as described in detail below.

Lower members 26 and 28 of support posts 16 and 18 extend horizontally from the lower edge of upright members 22 and 24 and are also of hollow tubular construction. Lower members 26 and 28 include a plurality of casters or wheels to facilitate easy transport of display fixture 10.

Figure 4:
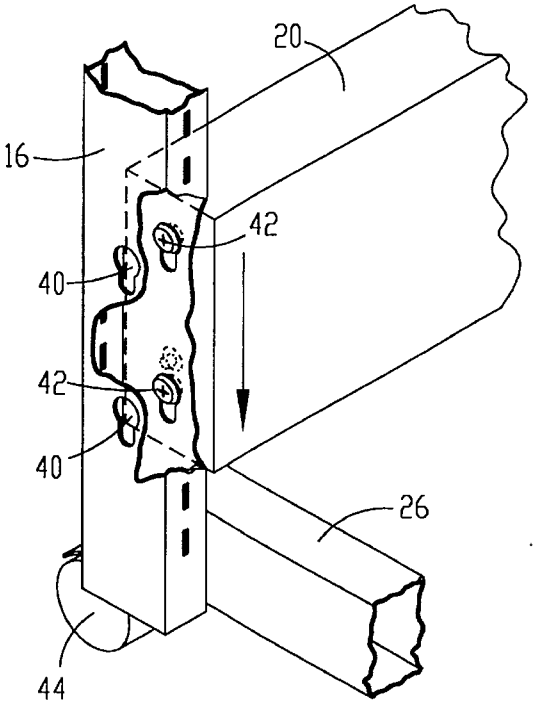
FIG. 4 is a partial view of a left support post and connecting cross member of the preferred invention illustrating the second step in connecting the cross member to the support post.
Figure 5:
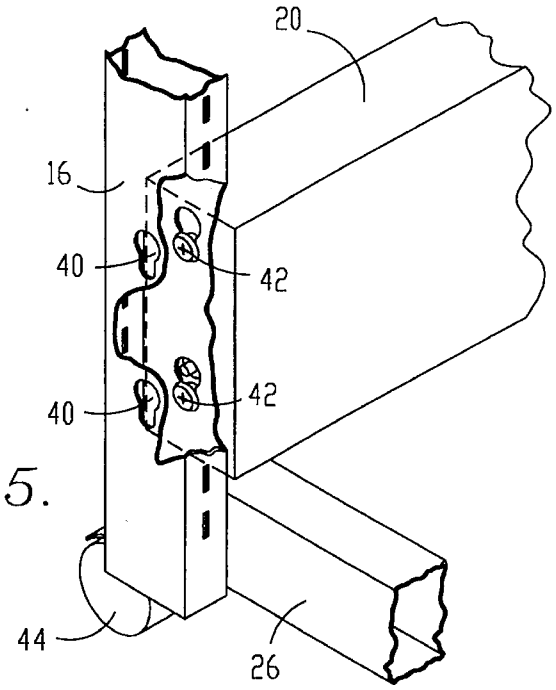
FIG. 5 is a partial view of a left support post and connecting cross member of the preferred invention illustrating the third step in connecting the cross member to the support post.
Figure 3:
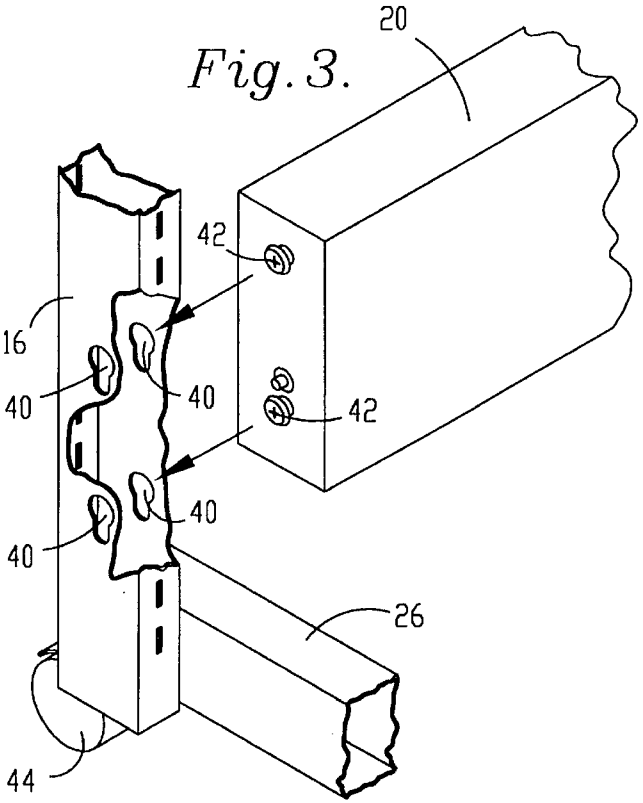
FIG. 3 is a partial view of a left support post and connecting cross member of the preferred invention illustrating the first step in connecting the cross member to the support post.

Connecting cross members 20 and 21 are elongated support members configured for securing left support post 16 to right support post 18. As illustrated in FIG. 2, cross member 20 secures the lower end of support posts 16 and 18 and cross member 21 secures the upper ends. Each cross member presents left and right opposed ends including a plurality of outwardly extending connection screws 42 adapted for engaging the key hole-shaped slots 40 of upright members 22 and 24. As best illustrated in FIGS. 3, 4 and 5, connection screws 42 and slots 40 cooperate to securely connect cross members 20 and 21 to left and right support posts 16 and 18 to form support frame 12.

In preferred forms, support frame 12 also includes cover member 45. Cover member 45 has a flat, rectangular-shaped surface which overlies lower members 26 and 28. In use, cover member 45 serves as a lower shelf on display fixture 10. Display panel 14 is an upright, planar panel removably mounted between support posts 16 and 18.

Display panel 14 as illustrated is configured for receiving attachment hooks or other display attachment devices and includes left and right outer vertical margins 46 and 48 and a plurality of horizontally extending slats 50. Panel 14 may be formed to receive various other types of display attachment devices.

Figures 6, 7, 8:
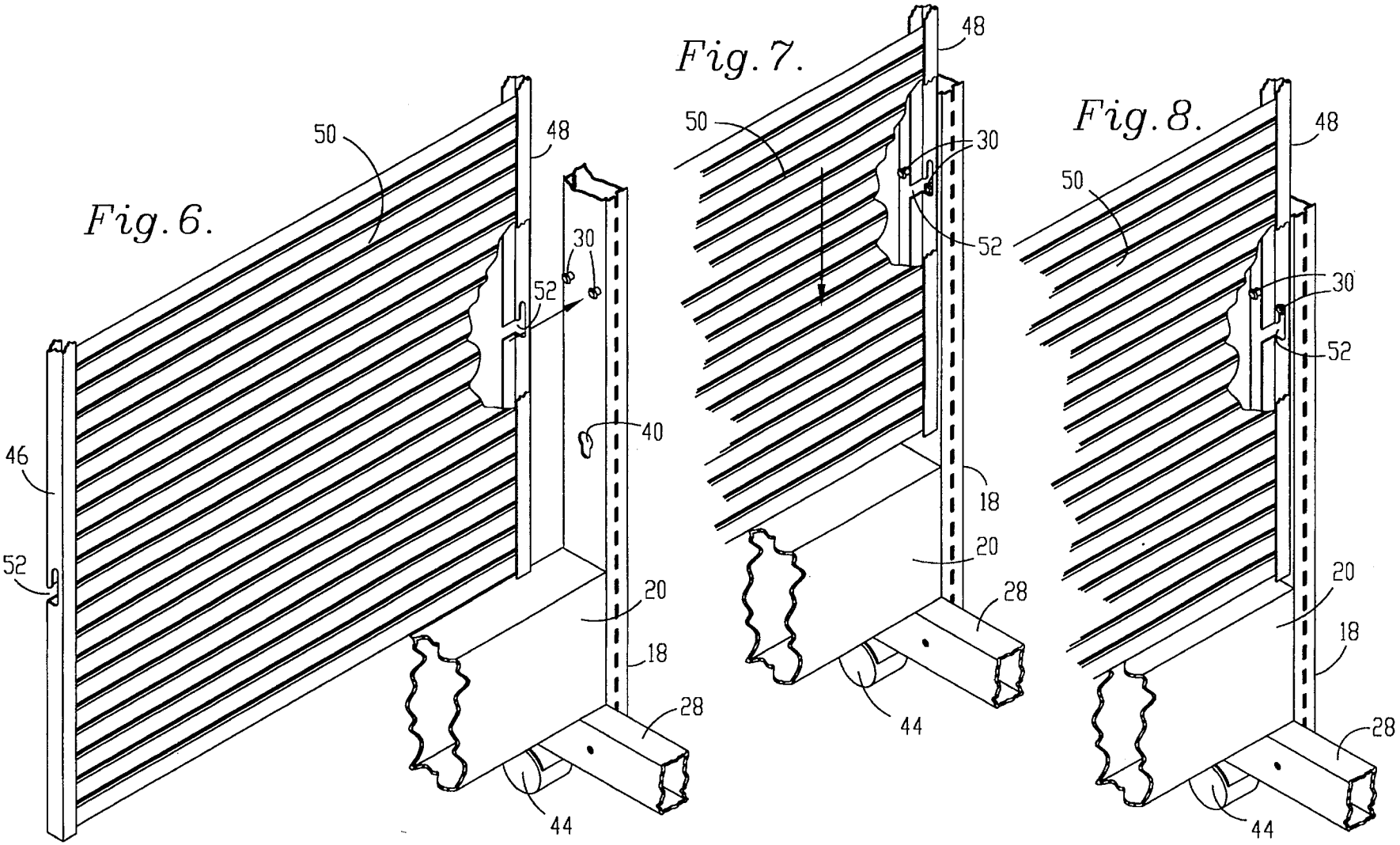
FIG. 6 is a partial view of a right support post, connecting cross member, and display panel of the preferred invention illustrating the first step in connecting the display panel to the support post.
FIG. 7 is a partial view of a right support post, connecting cross member, and display panel of the preferred invention illustrating the second step in connecting the display panel to the support post.
FIG. 8 is a partial view of a right support post, connecting cross member, and display panel of the preferred invention illustrating the third step in connecting the display panel to the support post.

As best illustrated in FIGS. 2 and 6, outer margins 46 and 48 include structure defining a plurality of essentially J-shaped slots 52 adapted for receiving connection pins 30 of support post upper members 16 and 18. As best illustrated in FIGS. 6, 7 and 8, connection pins 30 and slots 52 cooperate to securely connect display panel 14 to support frame 12.

Figure 13:
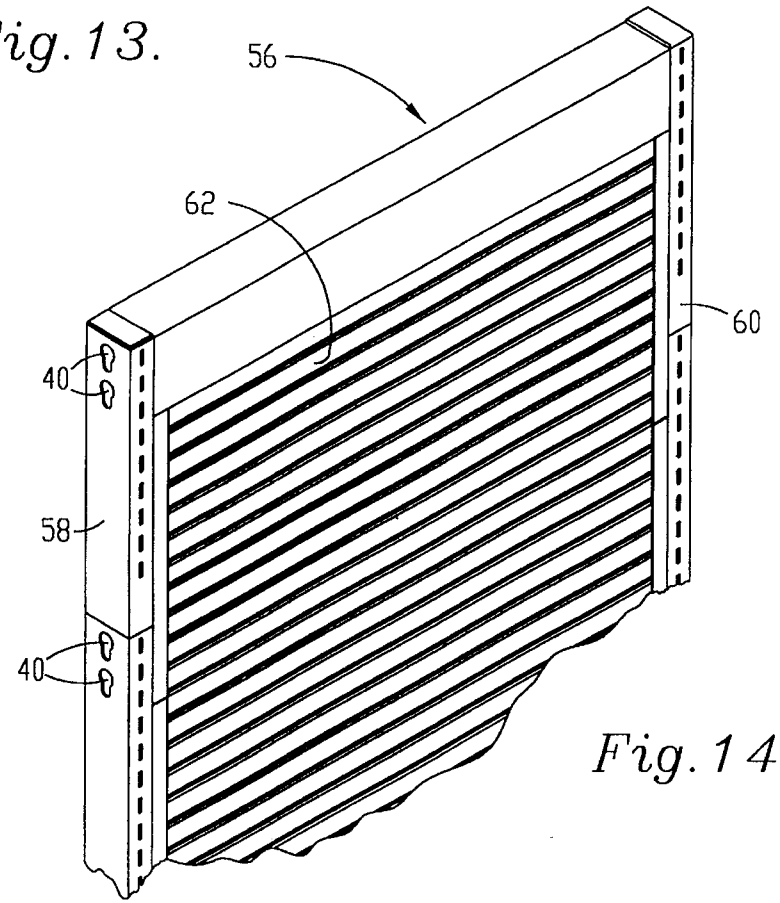
FIG. 13 is an isometric view of an extension assembly in accordance with the invention illustrating the first step in attaching the extension assembly to the display fixture.

Referring to FIG. 13, the preferred display fixture 10 also includes an extension assembly 56 for increasing the height of display panel 14. Extension assembly 56 includes a pair of vertical, spaced apart tubular extension posts 58 and 60 and a panel section 62 mounted therebetween. Extension posts 58 and 60 include downwardly extending angularly disposed tabs 64 and 66 configured for insertion in openings 32 and 34 of upright members 22 and 24. In the preferred embodiment, tabs 64 and 66 are oriented to fit diagonally in the rectangular-shaped openings. In this way, extension assembly 56 is securely connected to the display fixture yet does not interfere with the key hole slots 40 located at the upper margin of upright members 22 and 24.

In use, the modular components of display fixture 10 can be assembled quickly without the aid of tools. First, bottom cross member 20 and top cross member 1 are attached between left and right support posts 16 and 18 by inserting connection screws 42 into the top portion of key hole-shaped slots 40 as illustrated in FIGS. 3, 4 and 5. Once the connection screws are inserted, the cross members are locked in place by pushing the cross members downward, thereby urging connection screws 42 into the smaller, bottom portion of keyhole slots 40.

Second, cover member 45 is placed over support post lower members 26 and 28. As illustrated in FIG. 2, cover member 45 includes notches 47 which engage a tab structure 49 on lower members 26 and 28 for securing the cover member in place.

Third, display panel 14 is mounted between support posts 16 and 18 by placing the opening of J-shaped slots 52 over connection pins 30 of support post upper members 16 and 18. As illustrated in FIGS. 6, 7 and 8, display panel 14 is locked in place by urging the panel downwards so that connection pins 30 engage the upper, closed portion of the J-shaped slots.

Finally, upright member openings 32 and 34 are either closed with caps 36 and 38 or receive tabs 64 and 66 of extension assembly 56.

Figures 9, 10, 11, 12:
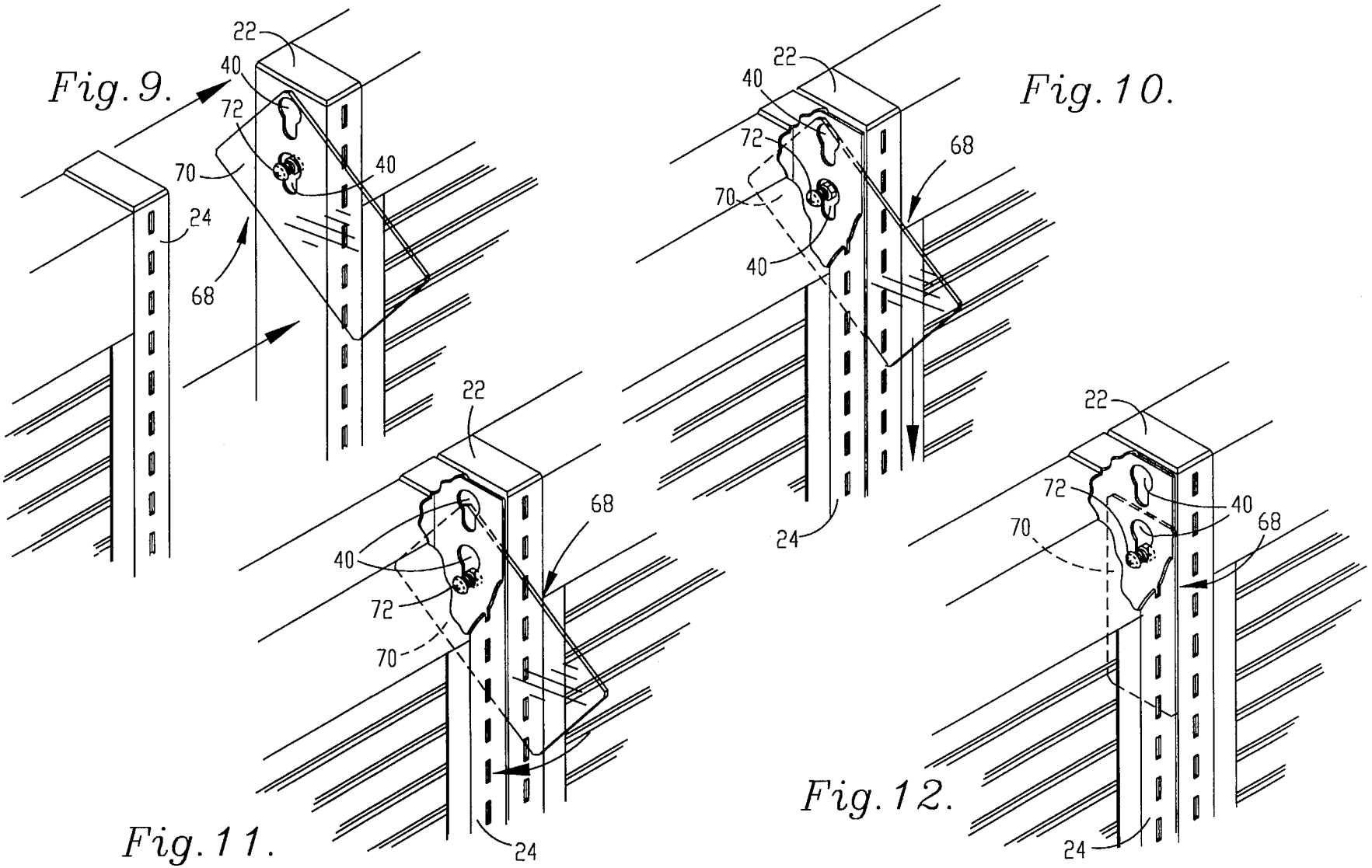
FIG. 9 is a partial view of a pair of assembled display fixtures and a securement tab illustrating the first step in securing two display fixtures together to form a display system.
FIG. 10 is a partial view of a pair of assembled display fixtures and a securement tab illustrating the second step in securing two display fixtures together to form a display system.
FIG. 11 is a partial view of a pair of assembled display fixtures and a securement tab illustrating the third step in securing two display fixtures together to form a display system.
FIG. 12 is a partial view of a pair of assembled display fixtures and a securement tab illustrating the fourth step in securing two display fixtures together to form a display system.
Figure 14:
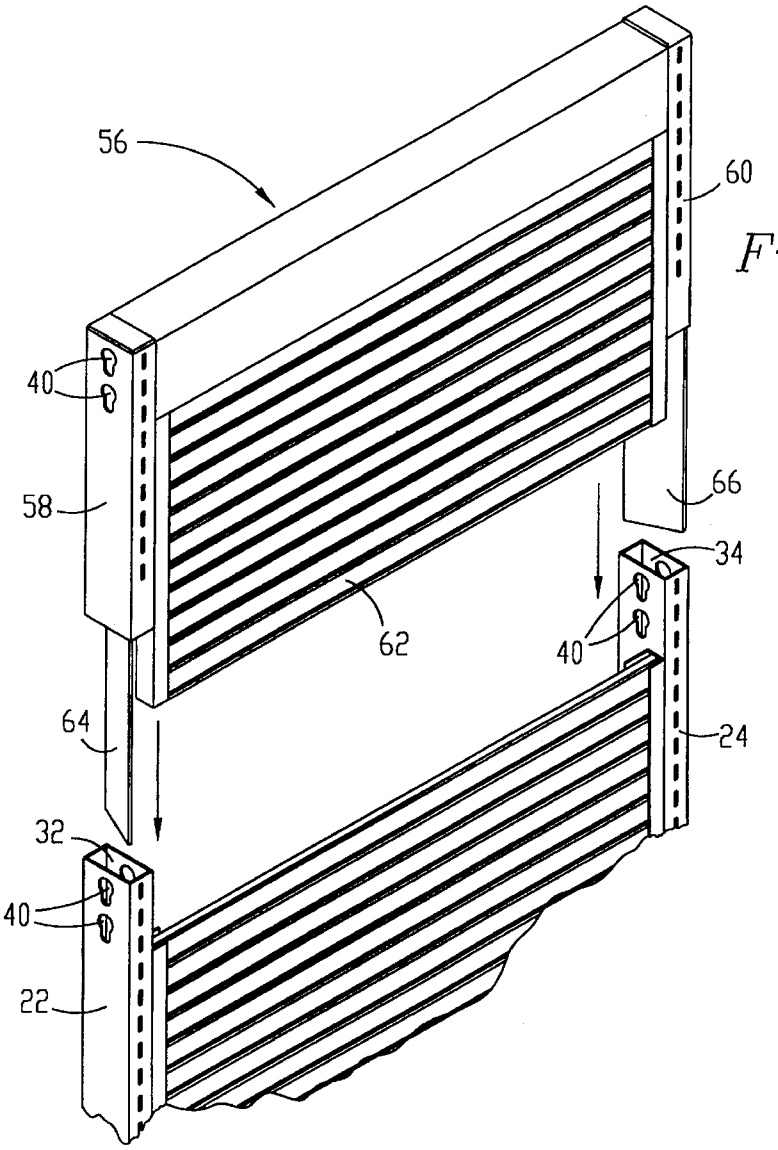
FIG. 14 is an isometric view of an extension assembly in accordance with the invention illustrating the second step in attaching the extension assembly to the display fixture.

The preferred invention also includes a novel securement tab 68 for connecting adjacent display fixtures to form a custom-sized display system. As illustrated in FIG. 9, preferred securement tab 68 includes a thin, rectangular-shaped planar tab portion 70 and a bolt assembly 72. Tab portion 70 is preferably manufactured of clear plastic and is adapted for insertion between support posts on adjacent display fixtures. Bolt assembly 72 is mounted perpendicularly through tab portion 70 and includes a bolt head extending from one end of tab portion 70 and a conventional hexagonal nut extending from the other end of the tab portion.

FIGS. 9, 10, 11, and 12 illustrate the connection of adjacent assembled display fixtures to form a custom-sized display system. First, securement tab 68 is placed adjacent one of the display fixtures, and one end of bolt assembly 72 is inserted into the upper, larger end of one of the key hole slots 40. Securement tab 68 is positioned so that the bottom end of tab portion 70 extends out from the display fixture. Second, the other display fixture is aligned side-by-side with the first display fixture and is pushed towards securement tab 68. Once aligned, the other end of bolt assembly 72 is inserted into the corresponding key hole slot 40 on the other display fixture. Third, the exposed bottom end of tab portion 70 is urged downwards as illustrated in FIG. 10 to lock bolt assembly in the lower, smaller portions of corresponding key hole slots 40. Finally, tab portion 70 is rotated inward so that its entire surface is hidden from view between adjacent display fixtures.

Figure 17:
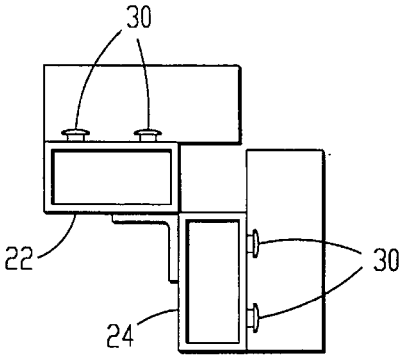
FIG. 17 is a top view of the corner piece of the display system of FIG. 15.
Figure 15:
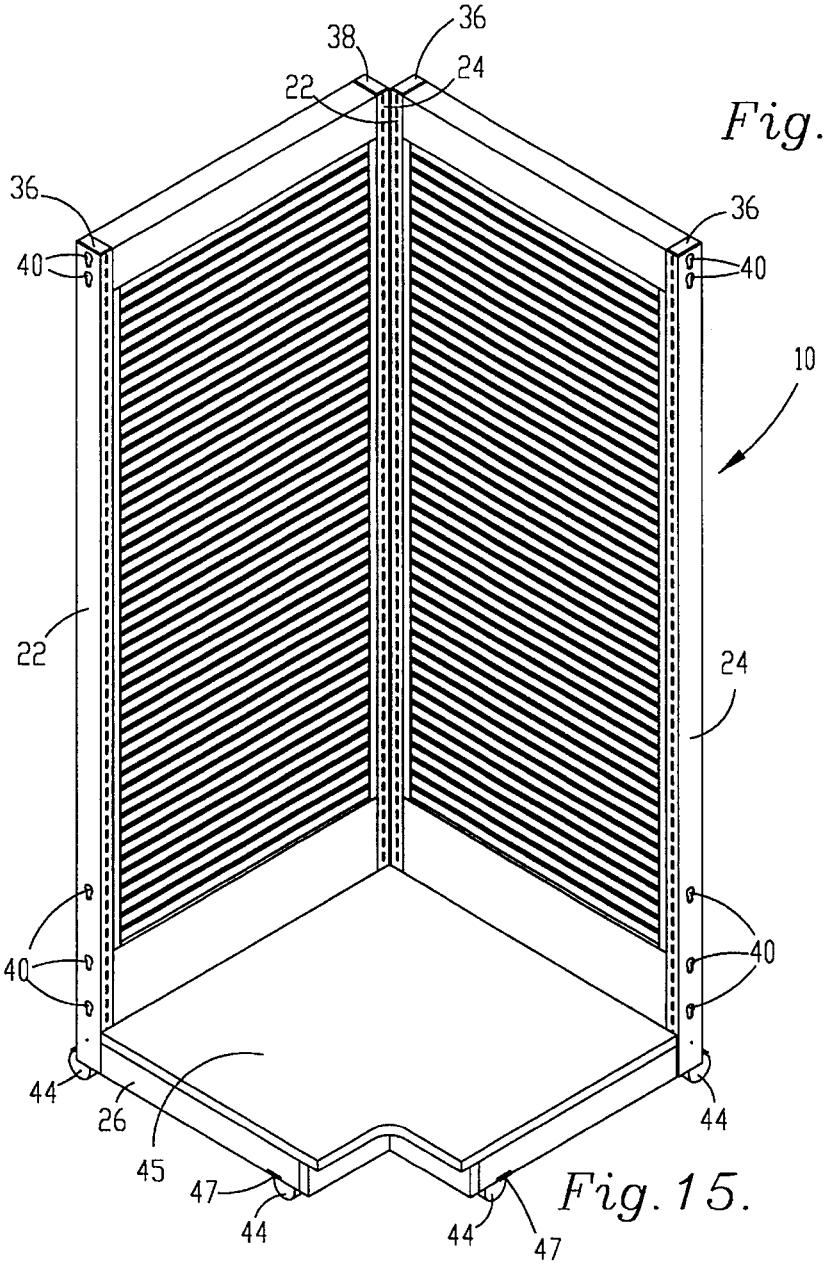
FIG. 15 is an isometric view of an exemplary display system created from a pair of assembled display fixtures.
Figure 16:
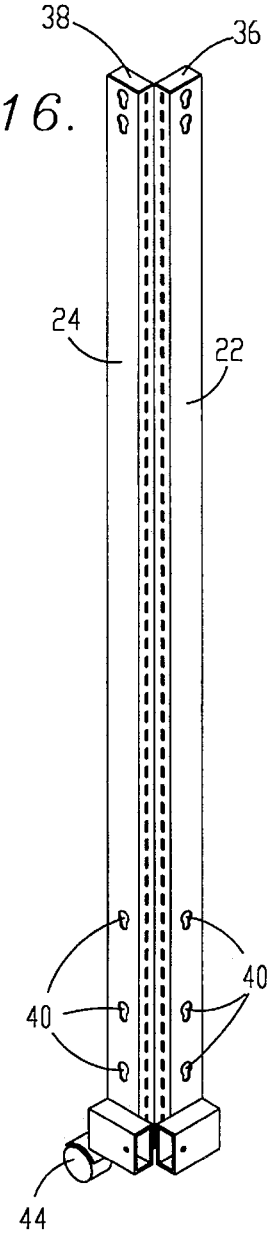
FIG. 16 is a detailed view of the corner piece of the display system of FIG. 15.

FIGS. 15, 16 and 17 illustrate one possible method of securing two assembled display fixtures together to create a custom-sized and designed display system. As those skilled in the art will appreciate, the display fixture and securement tab as described above provide for a multitude of display system options.

The preferred invention as described above provides many advantages. For example, the modular design of the display fixture allows it to be easily transported, assembled and disassembled, yet provides a display which is strong and portable. Moreover, the novel connection means on the support frame and display panel allows the display fixture to be assembled and disassembled quickly without tools. Finally, the novel securement tabs allows multiple display fixtures to be connected together easily without the use of tools to create a larger, custom-sized display system which can display nearly any quantity of goods.

As those skilled in the art will appreciate, the present invention encompasses many variations in the preferred embodiments described above. Having thus described the preferred embodiments of the invention, the following is claimed as being new and desired to be secured by Letters Patent.

I claim:

1. A modular display fixture comprising:

a support frame including a pair of parallel, spaced-apart tubular support posts connected by a cross member, said support posts presenting upper ends, said upper ends including structure defining a rectangular-shaped opening therein;

a planar display panel removably mounted between said spaced-apart support posts; and an extension assembly including a pair of parallel, spaced apart tubular extension posts adapted for connecting with said support frame support posts to increase the height of said display apparatus, said extension posts presenting lower ends including downwardly extending tabs for insertion in said support post rectangular-shaped openings, said tabs being oriented to fit diagonally in said rectangular-shaped openings.

2. The fixture as recited in claim 1, each of said support posts including a vertically extending upright member perpendicularly connected to a horizontally extending lower member.

3. The fixture as recited in claim 2, said support post horizontal lower members including wheels attached thereto.

4. The fixture as recited in claim 2, said support frame including a planar cover member adapted to bridge said support post lower members.

5. The fixture as recited in claim 1, said display panel including a plurality of horizontally extending slats mounted between said outer vertical margins for receiving attachment hooks.

6. A display system comprising:

a plurality of adjacent modular display apparatuses, each display apparatus including a support frame including a pair of parallel, spaced-apart support posts connected by a cross member, each of said support posts including a vertically extending upright member, said upright members each presenting interior and exterior faces, said upright members each including a plurality of connection pins extending from said interior faces and a plurality of orifices on said exterior faces, and a planar display panel removably mounted between said spaced-apart support posts and presenting left and right side margins, said left and right side margins each including a plurality of slots adapted for receiving said connection pins for mounting said planar display panel between said spaced-apart support posts; and securement means for securing said adjacent display apparatuses to one another, said securement means including a rectangular-shaped planar tab for insertion between said adjacent modular display apparatuses and a bolt assembly mounted transversely through said planar tab for coupling with said orifices on said outward faces of said upright members.

* * * * *